US005083327A

United States Patent [19]

Gillebaard

[11] Patent Number: 5,083,327

[45] Date of Patent: Jan. 28, 1992

[54] PORTABLE SWIMMING POOL

[76] Inventor: Hendrik C. Gillebaard, 1120 Calle Cordillera, San Clemente, Calif. 92672

[21] Appl. No.: 566,146

[22] Filed: Aug. 9, 1990

[51] Int. Cl.[5] ..... E04H 4/00

[52] U.S. Cl. ..... 4/506; 220/4.16; 220/648

[58] Field of Search ..... 4/487, 488, 506, 507, 4/513, 584–587, 599; 220/9.1, 4.16, 648; 52/245

[56] References Cited

U.S. PATENT DOCUMENTS

| | | | |
|---|---|---|---|
| 1,664,887 | 4/1928 | Kirkham et al. | 4/506 X |
| 2,378,159 | 6/1945 | Royer | 220/9.1 X |
| 3,225,362 | 12/1965 | Barrera | 4/506 X |
| 3,443,263 | 5/1969 | Minasy | 52/245 |
| 4,356,933 | 11/1982 | Connolly | 4/506 X |
| 4,890,343 | 1/1990 | Schlags | 4/585 |
| 4,989,751 | 2/1991 | Gillett | 220/648 X |

FOREIGN PATENT DOCUMENTS

| | | | |
|---|---|---|---|
| 1123409 | 9/1956 | France | 4/506 |
| 478106 | 8/1975 | U.S.S.R. | 4/506 |
| 767621 | 2/1957 | United Kingdom | 4/506 |
| 1037127 | 7/1966 | United Kingdom | 4/506 |

*Primary Examiner*—Henry J. Recla
*Assistant Examiner*—Robert M. Fetsuga
*Attorney, Agent, or Firm*—Stetina and Brunda

[57] ABSTRACT

An improved, portable, above-the-ground swimming pool is disclosed which comprises a liner portion adapted to have a frame portion attached thereto. The liner portion consists of a polyester inner lining coated with waterproof vinyl having a plurality of horizontally and vertically oriented sleeves attached to various locations thereon which are adapted to receive rim members and wall members comprising the frame portion. The pool is adapted to be easily and quickly assembled and disassembled and to avoid tearing or puncture.

2 Claims, 2 Drawing Sheets

PORTABLE SWIMMING POOL

FIELD OF THE INVENTION

The present invention relates generally to recreational devices and more particularly to an above-the-ground, portable swimming pool specifically adapted to be easily and quickly assembled and disassembled.

BACKGROUND OF THE INVENTION

Today, a number of prior art configurations and methods of construction are known for above-the-ground swimming pools. Typically, such pools are comprised of a generally circular, rigid support frame having a plurality of sheet metal panels attached about the periphery thereof. Disposed within the support frame is a liner which forms a basin into which a quantity of water is pumped. Such pools, though serving their primary recreational purpose, are not configured to be easily disassembled and reassembled. Thus, in climates where the pool may not be utilized year round, various time-consuming and expensive procedures must be performed to "winterize" the pool. Such procedures usually include the placement of special coverings on the pool as well as the accompanying filtration devices. Additionally, the pool owner is generally precluded from moving the pool to an alternate location within a yard or to a new home. In this respect, the time, difficulty and potential for pool damage associated with moving currently-known pools make such a move impractical.

Although a number of portable pools are known in the prior art, such pools as presently known possess certain inherent design deficiencies. One such pool which is marketed by Porta Industries utilizes an air-filled pontoon as a means of providing support to a water retaining liner. Though the liner itself is water-tight, the rupturing of the air-filled pontoon will cause the support structure to collapse thereby spilling the water contained within the pool. Additionally, a second currently marketed portable pool utilizes a liner portion constructed from a vinyl which is susceptible to shrinkage and drying out when exposed to air and sunlight, thereby necessitating that the pool be constantly filled with water to prevent such derogatory effects from occurring. Additionally, this pool is designed in a manner involving a particularly difficult and lengthy installation process.

The present invention overcomes these and other deficiencies by providing a portable pool which may be easily and quickly assembled, disassembled or reconstructed and which is fabricated from materials so as not to be easily susceptible to puncture, leakage or the effects of air and sunlight.

SUMMARY OF THE INVENTION

In accordance with a preferred embodiment of the present invention, there is provided a portable, above-the-ground swimming pool which may be easily assembled, disassembled and reconstructed. The pool generally comprises a frame portion having a liner portion attached thereto, wherein the liner portion is fabricated in a manner so as to form a generally circular water-retaining basin. In the preferred embodiment, the liner comprises an upper rim having a plurality of elongate, longitudinally extending rim sleeves attached along the periphery thereof. Extending downwardly from the upper rim is a sidewall which defines an outer surface and a water contacting inner surface. Attached to the outer surface of the sidewall are a plurality of equidistantly spaced, elongate wall sleeves which extend vertically downwardly from the upper rim to the lower corner of the liner. The liner also includes a belt which is secured within straps attached to each of the individual wall sleeves such that the belt extends completely about the outer surface of the sidewall. The belt, which is constructed from tri-ply PVC is used to provide additional external structural support to the frame portion of the pool. The liner itself is constructed from a polyester inner lining which is coated on each side with a waterproof vinyl. Importantly, the lower, ground contacting corner of the liner has a layered, reinforced construction thereby providing additional strength thereto. Also included within the sidewall is a valve assembly which is used for pumping and filtering the water retained within the liner.

The frame portion of the pool generally comprises a plurality of horizontally disposed, elongate rim members and a plurality vertically disposed, elongate wall members. Importantly, the rim members are sized and configured to be slidably received into the rim sleeves of the liner while the wall members are sized and configured to be slidably received into the wall sleeves of the liner, thereby facilitating the rapid attachment of the liner portion to the frame portion. The rim members and wall members, which are preferably constructed from PVC tubing, are interconnected through the utilization of generally T-shaped joint members. In this respect, any two of the rim members are connected in end-to-end fashion through the attachment of one end of each of the rim members to the opposing, horizontally extending ends of the joint member. One end of a single wall member is connected to the third, downwardly extending end of the T-shaped joint member. In this regard, the rim sleeves and wall sleeves are oriented on the liner such that the rim members and wall member may be received therein after being attached to a joint member in the aforementioned manner. Base members are also provided, wherein each is adapted to receive and support the end of a wall member opposing the end connected to the joint member so as to aid in maintaining the wall member in an upright, vertical position. As can be appreciated, the attachment of all the rim members in end-to-end fashion will form an enclosed, circular configuration matching the shape of the upper rim of the liner. Due to the manner in which the rim members and joint members are connected, at least one joint member must be designed so as to be insertable within the enclosed configuration. In this regard, one joint member includes a spring mechanism whereby such insertion may be accomplished.

It is an object of the present invention to provide an above-the-ground swimming pool which is portable.

Another object of the present invention is to provide an above-the-ground swimming pool which is adapted to be easily and quickly disassembled and reassembled.

A further object of the present invention is to provide an above-the-ground swimming pool fabricated from materials so as not to be susceptible to puncture, leakage or derogatory effects from air and sunlight.

Further objects and advantages of the invention will become apparent to those skilled in the art upon reading and consideration of the following description of a preferred embodiment and the accompanying drawings.

BRIEF DESCRIPTION OF THE DRAWINGS

These as well as other features of the present invention will become apparent upon reference to the drawings wherein.

DETAILED DESCRIPTION OF THE PREFERRED EMBODIMENT

Figure 1:
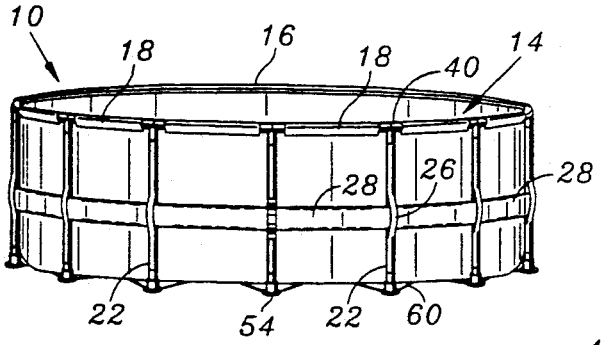
FIG. 1 is a perspective view of the portable swimming pool of the present invention after assembly thereof.

Referring now to the drawings wherein the showings are for purposes of illustrating a preferred embodiment of the present invention and not for purposes of limiting the same, FIG. 1 perspectively illustrates the portable pool assembly 10 of the present invention. Importantly, pool assembly 10 by its design and construction is intended to serve only as an above-the-ground pool. Pool assembly 10 generally comprises a frame portion 12 and a liner portion 14 which is adapted to be secured to frame portion 12.

Figure 2:
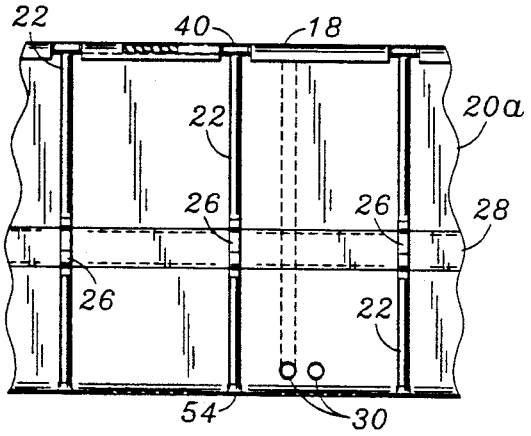
FIG. 2 is a side elevational view of one segment of the sidewall of the assembled swimming pool, particularly illustrating inlet and outlet valves disposed within the sidewall.
Figure 3:
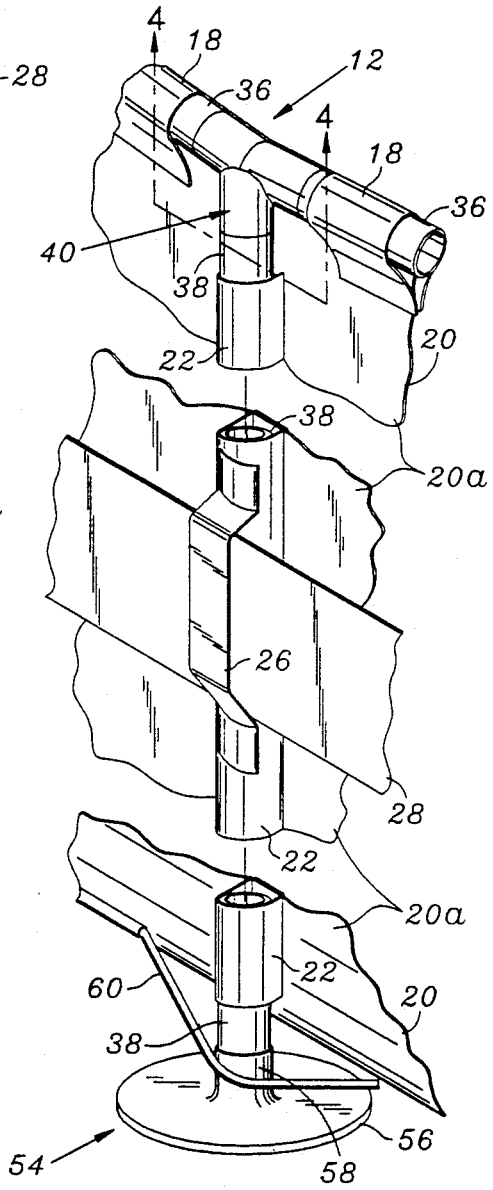
FIG. 3 is an enlarged perspective view of a portion of the pool sidewall, illustrating the interface of various frame components to each other and to the liner.

Referring now to FIGS. 1-3, in the preferred embodiment liner 14 is fabricated so as to form a water-retaining basin having a generally circular configuration. As will be appreciated however, the liner and frame portion of the pool may be constructed in a manner so as to have a number of differently shaped configurations, the circular configuration only serving as one embodiment. Additionally, liner 14 is preferably constructed from a polyester inner lining coated with a water-proof vinyl, though it will also be appreciated that a number of different materials may be used in the construction of liner 14. Advantageously, the aforementioned manner of construction is operable to make liner 14 less susceptible to puncture, leakage or the effects of air and sunlight. Liner 14 generally comprises an annular upper rim 16 having a plurality of elongate, longitudinally extending rim sleeves 18 attached along the periphery thereof, the use of which will be explained below. Extending downwardly from upper rim 16 is a sidewall 20 which defines an outer surface 20*a* and an inner, water contacting surface 20*b*. Attached to outer surface 20*a* of sidewall 20 are a plurality of equidistantly spaced, elongate wall sleeves 22 which extend vertically downwardly from upper rim 16 to the lower corner portion 24 of liner 14, the use of which will also be explained below. Importantly, attached to each of wall sleeves 22 is an elongate strap member 26 which extends longitudinally thereon. In this regard, the opposing ends of each strap member 26 are attached to wall sleeves 22 in a manner forming a loop-like structure. Advantageously, each loop formed by the attachment of a strap member 26 to Wall sleeves 22 is adapted to receive a belt 28 which extends about the periphery of the outer surface 20*a* of sidewall 20. Belt 28 is used to provide additional structural support to frame portion 12 of pool assembly 10 after a quantity of water is pumped into liner 14. As best seen in FIGS. 1 and 2, each strap member 26 is attached to each of wall sleeves 22 in generally the same location and orientation such that belt 28 extends about outer surface 20*a* of sidewall 20 while maintaining a generally horizontal orientation. In the preferred embodiment, belt 28 is constructed from tri-ply PVC, though it will be appreciated that other materials may be utilized in the fabrication thereof. Also included within sidewall 20 of liner 14 are valves 30 which are used for pumping and filtering water retained within liner 14.

Figure 7:
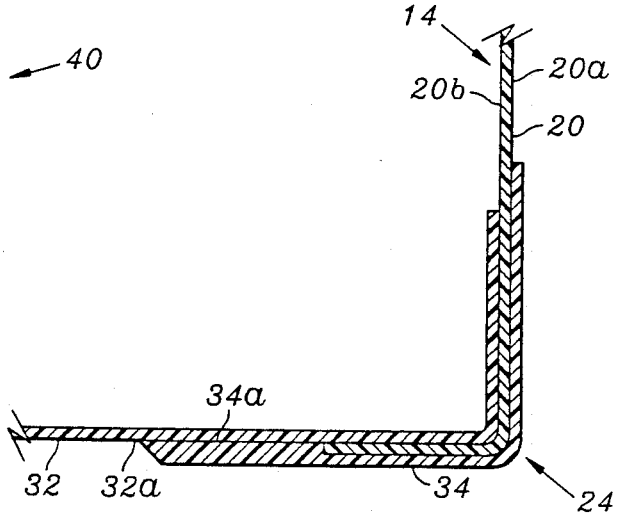
FIG. 7 is a cross-sectional view of the lower edge of the pool liner, illustrating the layered construction thereof.

Referring now to FIG. 7, the lower, ground contacting corner portion 24 of liner 14 is given a reinforced construction so as to avoid any tearing or puncturing when liner 14 is filled with water. In this regard, sidewall 20 is overlapped with the floor portion 32 of liner 14 such that a portion of inner surface 20*b* of sidewall 20 is adhered to outer surface 32*a* of floor portion 32. Additionally, a reinforcement member 34 is attached about the periphery of lower corner 24 wherein the inner surface 34*a* of reinforcement member 34 is adhered to portions of outer surface 20*a* of sidewall 20 and outer surface 32*a* of floor portion 32 thereby creating a lower edge of increased thickness and strength. In the preferred embodiment, the adhesion of sidewall 20 to floor portion 32 and of reinforcement member 34 to lower corner 24 is facilitated by a heat sealing process though other sealing methods such as adhesives or the like may be utilized.

Figure 4:
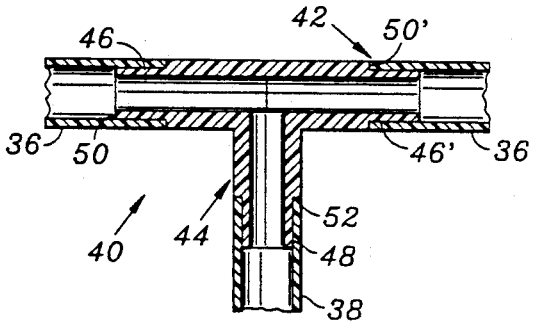
FIG. 4 is a cross-sectional view illustrating the engagement of a joint member to two rim members and a wall member of the pool frame taken along line 4—4 of FIG. 3.
Figure 5:
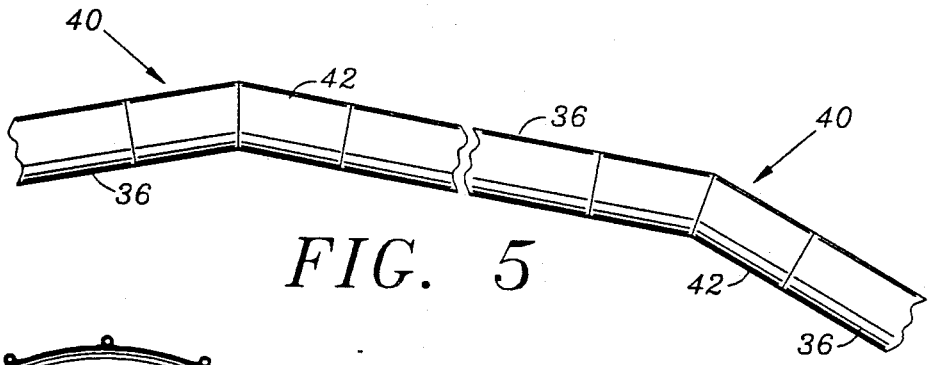
FIG. 5 is a top view of a segment of the upper rim of the assembled pool, particularly illustrating the shape of the horizontal portion of the joint members.
Figure 6:
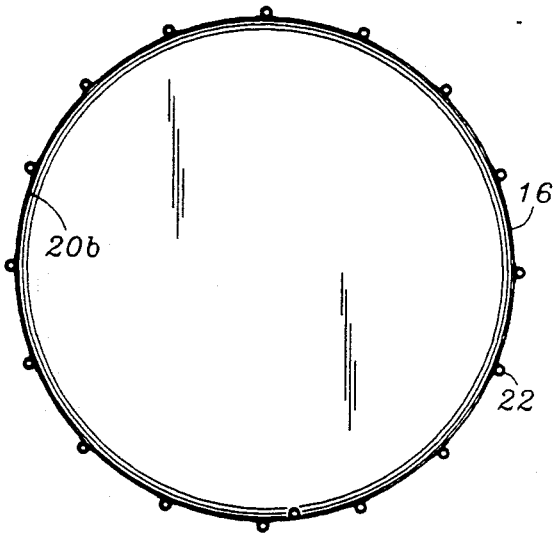
FIG. 6 is a top view of the portable pool of the present invention after assembly thereof.
Figure 8:
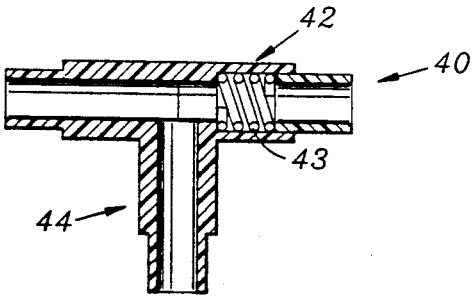

In the preferred embodiment, frame portion 12 is adapted to be attached to liner 14. In this respect, frame portion 12 generally comprises a plurality of rim members 36 and wall members 38. Importantly, rim sleeves 18 are sized and configured to slidably receive rim members 36, while wall sleeves 22 are sized and configured to slidably receive wall members 38. Rim members 36 and wall members 38 are preferably constructed from PVC tubing though it will be appreciated that other materials may be utilized therefore. A plurality of generally T-shaped joint members 40 having a horizontal portion 42 and a vertical portion 44 are used to interconnect rim members 36 so as to form an enclosed configuration adapted to match the shape of upper rim 16 of liner 14. In this respect, each of joint members 40 is adapted to connect any two of rim members 36 in end-to-end fashion thereby forming the generally enclosed circular rim configuration as best seen in FIGS. 5 and 6. Importantly, each of joint members 40 is also adapted to secure the top end of a wall member 38 such that wall member 38 extends vertically downwardly therefrom. Referring now to FIG. 4, each of joint members 40 is engaged to any two of rim members 36 and a single wall member 38 through the utilization of first coupling portions 46, 46′ formed within horizontal portion 42 and second coupling portion 48 formed within vertical portion 44. In this respect, first coupling portions 46, 46′ are each slidably received into one end of rim members 36, such receipt being limited by the abutment of the outer edges of rim members 36 against annular shoulders 50, 50′ defined by first coupling portions 46, 46′. Advantageously, the outer surfaces of rim members 26 and horizontal portion 42 have a smooth configuration when interconnected. Wall member 38 is connected to second coupling portion 48 in a similar manner whereby second coupling portion 48 is slidably received into one end of wall member 38, such receipt being limited by the abutment of the upper edge of wall member 38 against a second annular shoulder 52 defined by second coupling portion 48. In this respect, the outer surfaces of vertical portion 44 and wall members 38 also have a smooth configuration when interconnected. As best seen in FIG. 5, horizontal portion 42 of each of joint members 40 does not have a straight configuration but is slightly angled so as to facilitate the formation of frame portion 12 with a generally circular configuration corresponding to the shape of upper rim 16. As can be appreciated from the manner in which joint members 40 are interfaced with rim members 36, in constructing frame portion 12 of pool assembly 10, at least one joint member 40 must be constructed in a manner so as to be insertable into the enclosed configuration. Thus, in the preferred embodiment one of joint members 40 is manufactured such that horizontal portion 42 is spring-loaded (not shown) thereby allowing the joint member to be inserted into the enclosed configuration.

As best seen in FIG. 3, the lower end of each of wall members 38 is attached to a base member 54. Each base member 54 generally comprises a generally circular bottom plate 56 having an upwardly extending cylindrical member 58 attached thereto. To facilitate such attachment, the upper end of cylindrical member 58 also includes a coupling member (not shown) which is adapted to be slidably received into the lower end of each of wall members 38. In this regard, each base member 54 is used to provide additional vertical support to each of wall members 38. Additionally, disposed along lower corner 24 of liner 14 is a cord 60, portions of which extend outwardly from liner 14 and are adapted to wrap around cylindrical member 58, thereby maintaining base member 54 in close proximity to liner 14, as well as providing additional structural support to frame portion 12.

One of the most significant distinctions between pool assembly 10 and currently known portable and permanent above-the-ground swimming pools is that in the present invention, liner 14 is the primary load bearing member of the configuration. In currently known pools, the frame portion is the primary load bearing component, thereby necessitating that the frame have a rigid construction. The need for such rigidity adds time and complexity to the construction process of the frame, thereby making the assembly or disassembly thereof a difficult task. Typically, after the frame is constructed, the liner is placed therein in a manner so as to insure that the load is transferred to the frame. In the present invention, liner 14 is adapted to receive frame portion 12 as opposed to frame portion 12 receiving liner 14. In this regard, the construction of liner 14, particularly with the utilization of belt 28, makes liner 14 itself the primary load bearing component, thus making the assembly and disassembly of pool assembly 10 a quick and easy process.

Additional modifications and improvements of the present invention may also be apparent to those skilled in the art. Thus, the particular combination of parts described and illustrated herein in intended to represent only one embodiment of the invention, and is not intended to serve as limitations of alternative devices within the spirit and scope of the invention.

What is claimed is:

1. A portable, above-the-ground swimming pool comprising: a frame portion comprising:

a plurality of substantially rigid, elongate rim members;

a plurality of substantially rigid, elongate wall members, each of said wall members having a top and a bottom end;

a plurality of joint members, wherein each of joint members is adapted to connect any two of said rim members in end-to-end fashion to form an enclosed configuration while simultaneously securing said top end of any one of said wall members such that said any one of said wall members extends vertically downwardly therefrom; and a plurality of base members, each of said base members being adapted to receive and support said bottom end of any one of said wall members in an upright position;

a flexible liner portion sized and configured to have said frame portion secured thereto in a manner wherein said liner portion is the primary load bearing member of said pool and forms a water-retaining basin therein, said liner portion comprising:

an upper rim including a plurality of horizontally disposed, elongate rim sleeves attached along the periphery thereof, said rim sleeves being sized and configured to slidably receive said rim members in a manner substantially covering said rim members;

a side wall extending downwardly from said upper rim, said side wall having an inner, water-contacting surface and an outer surface;

a floor portion;

a corner portion whereat said side wall is connected to said floor portion; and a belt attached to and extending about the outer surface of said side wall for providing structural support to said frame portion;

said side wall further including a plurality of vertically disposed, elongate wall sleeves attached about the outer surface thereof and extending downwardly from said upper rim to said corner portion, said wall sleeves being sized and configured to slidably receive said wall members in a manner substantially covering said wall members, each of said wall sleeves including a loop member attached thereto which is sized and configured to receive said belt, each said loop member being positioned on a respective one of said wall sleeves in a manner wherein said belt has a substantially horizontal orientation when attached to said side wall.

2. The device of claim 1 wherein belt is constructed from tri-ply PVC.

* * * * *